US007309808B1

(12) United States Patent
Scott et al.

(10) Patent No.: US 7,309,808 B1
(45) Date of Patent: Dec. 18, 2007

(54) PROCESS FOR NON-INCINERATION DECONTAMINATION OF HAZARDOUS AGENTS

(75) Inventors: John A. Scott, Arcadia, CA (US); James Osterloh, West Richland, WA (US)

(73) Assignee: Parsons Corporation, Pasadena, CA (US)

( * ) Notice: Subject to any disclaimer, the term of this patent is extended or adjusted under 35 U.S.C. 154(b) by 917 days.

(21) Appl. No.: 10/677,954

(22) Filed: Oct. 1, 2003

Related U.S. Application Data

(63) Continuation-in-part of application No. 10/183,580, filed on Jun. 26, 2002, now Pat. No. 6,660,900, which is a continuation-in-part of application No. 09/781,818, filed on Feb. 12, 2001, now Pat. No. 6,462,249.

(51) Int. Cl.
*A62D 3/00* (2006.01)

(52) U.S. Cl. ..... 588/312

(58) Field of Classification Search ..... 423/235, 423/239.1; 588/202, 200, 205, 213, 223, 588/226, 312; 86/50
See application file for complete search history.

(56) References Cited

U.S. PATENT DOCUMENTS 3,440,096 A 4/1969 Scott
3,810,788 A 5/1974 Steyermark
5,370,845 A 12/1994 Miller et al.
5,470,544 A 11/1995 Galloway
5,689,038 A 11/1997 Bartram et al.
5,737,709 A 4/1998 Getty et al.
5,970,420 A 10/1999 Scott
5,998,691 A 12/1999 Abel et al.
6,462,249 B2 * 10/2002 Scott et al. ..... 588/312
6,660,900 B2 * 12/2003 Scott et al. ..... 588/312

* cited by examiner

*Primary Examiner*—Edward M. Johnson
(74) *Attorney, Agent, or Firm*—Denton L. Anderson; Sheldon Mak Rose & Anderson PC

(57) ABSTRACT

A process for the low temperature, non-incineration decontamination of contaminated materials, such as chemical weapon components containing residual quantities of chemical warfare agents. The process includes the steps of (a) contacting the contaminated materials with steam at substantially ambient pressure in a substantially dry first heated vessel for a period of at least about 15 minutes, the steam being at a temperature of at least about 560° C., (b) removing condensible and non-condensible gases from the first heated vessel and heating them in a second vessel at substantially ambient pressures to temperatures of at least about 500° C. for a period of at least about one second in an atmosphere containing steam, and (c) catalytically treating non-condensible gases from the second vessel in the presence of oxygen so as to reduce the concentration of chemical warfare agents to less than about 1.0 mg/m$^3$ at standard temperature and pressure.

29 Claims, 6 Drawing Sheets

PROCESS FOR NON-INCINERATION DECONTAMINATION OF HAZARDOUS AGENTS

RELATED APPLICATIONS

This application is a continuation-in-part of U.S. patent application Ser. No. 10/183,580, filed Jun. 26, 2002 now U.S. Pat. No. 6,660,900, which was a continuation-in-part of U.S. patent application Ser. No. 09/781,818, filed Feb. 12, 2001, now U.S. Pat. No. 6,462,249.

FIELD OF THE INVENTION

This invention relates generally to processes for decontaminating contaminated materials, such as chemical weapon components, and, more specifically, to processes for decontaminating contaminated materials without using incineration methods.

BACKGROUND OF THE INVENTION

The decontaminating of contaminated material can be very difficult. This is especially the case with respect to the decommissioning of chemical weapons carrying chemical warfare agents. The principal problem in this regard is how to safely remove, neutralize and dispose of the extremely toxic chemical warfare agents used in such chemical weapons. Modern technology has become increasingly successful in the neutralization of these chemical warfare agents—once the agents have been removed from the chemical weapon housing. However, after the bulk of the chemical warfare agents have been removed from the chemical weapons housings, the housings and their various components typically remain contaminated with residual amounts of the chemical warfare agents. The decontamination of these chemical weapon components remains a difficult problem.

Most prior art methods for decontaminating chemical weapon components have employed a two-step process. In a first step, the components are subjected to liquid chemicals or to high temperatures to remove and decompose essentially all of the chemical warfare agents adhering to the chemical weapon components. In a second step, residual vapors from the first step are incinerated to eliminate any and all residual chemical warfare agents in those vapors.

The incineration step has now been questioned, however, as possibly allowing potentially toxic combustion products to be released to the atmosphere. Accordingly, the incineration step has been banned in many industrial countries, including in the United States.

Thus, there is a need for a new method of decontaminating chemical weapon components which completely eliminates all traces of chemical warfare agents in an efficient and inexpensive manner, and without the use of an incineration step.

SUMMARY

The invention satisfies this need. The invention is a process for the low temperature, non-incineration decontamination of contaminated materials containing hazardous agents, the process comprising (a) contacting the contaminated materials and the hazardous agents with steam at substantially ambient pressure in a substantially dry first heated vessel for a period of at least about 15 minutes, the steam being at a temperature of at least about 560° C., whereby essentially all of the hazardous agents are removed from the contaminated materials, (b) removing a first gaseous discharge stream containing hazardous agents from the first heated vessel, the first gaseous discharge stream comprising a condensible moiety and a non-condensible moiety, (c) heating the first gaseous discharge stream at substantially ambient pressure in a substantially dry second vessel to at least about 500° C. and maintaining the first gaseous discharge stream in the second vessel of at least about 500° C. for a period of at least about one second in an atmosphere containing sufficient steam such that at least about 99 weight percent of the hazardous agents within the first gaseous discharge stream are converted to non-hazardous agents, (d) removing a second gaseous discharge stream containing a reduced concentration of hazardous agents from the second vessel, the second gaseous discharge stream comprising a condensible moiety and a non-condensible moiety, and (e) catalytically treating the second gaseous discharge stream in the presence of oxygen so that the concentration of hazardous agents within the non-condensible moiety of the second gaseous discharge stream is reduced to less than about 1.0 $mg/m^3$ at standard temperature and pressure.

The process is especially applicable where the contaminated materials are chemical weapon components and the hazardous agents are chemical warfare agents.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a process for the low temperature, non-incineration decontamination of contaminated materials containing hazardous agents. By "hazardous agents," it is meant any chemical compound or material which is considered harmful to humans and/or other life forms. Hazardous agents are typically organic in nature, but can also be toxic metals or metal compounds which are volatilized at temperatures between 560° C. and 750° C. Such metals include mercury and lead.

The invention is especially applicable to the decontamination of chemical weapon components, wherein the hazardous agents are chemical warfare agents. By the term "chemical warfare agents," it is meant any chemical which, through its chemical action on life processes, can cause death, temporary incapacitation or permanent harm to humans or animals.

Figure 1:
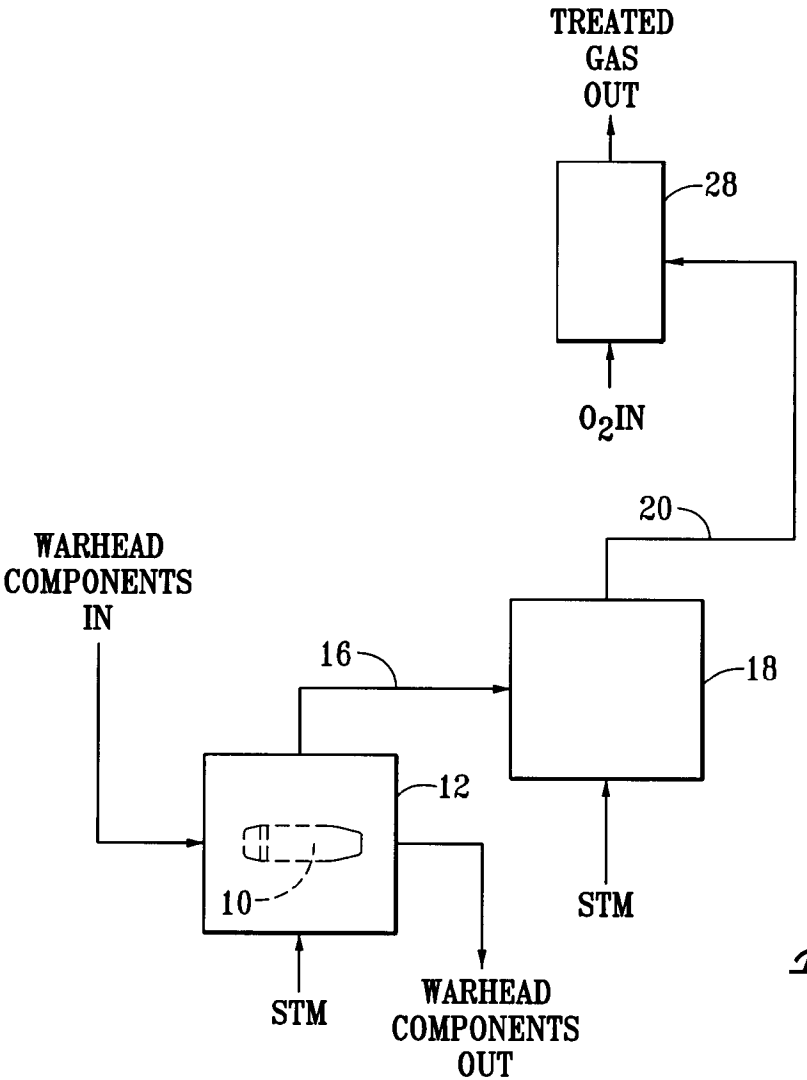
FIG. 1 is a process flow diagram illustrating the process of the invention.

In the process, as illustrated in FIG. 1, the chemical weapon components 10, such as missile warheads or bombs, are opened and the chemical warfare agents contained therein are flushed out. That portion of the chemical warfare agents flushed out of the chemical weapon components 10 are then removed to a separate treating facility (not shown) for pacification.

After being flushed out, the chemical weapon components 10 continue to be contaminated with residual amounts of the chemical warfare agents. These flushed out, but still contaminated, chemical weapon components 10 are next sealed within a substantially dry first heated vessel 12. Within the first heated vessel 12, the chemical warfare agents are contacted with steam at a substantially ambient pressure for a period of at least about 15 minutes, typically for a period of between about 15 minutes and about 4 hours, most typically for a period between about 15 minutes and about 2 hours. By "substantially ambient pressure," it is meant at a pressure between about 14.5 psia and about 14.7 psia. The temperature of the steam in contact with the chemical warfare agents within the first heated vessel 12 is at least about 560° C., and is typically between about 560° C. and about 750° C. By this contacting step, essentially all of the chemical warfare agents within, and adhering to, the chemical weapon components 10 are removed from the chemical weapon components 10 and transferred into a gaseous steam-containing phase.

The gaseous, steam-containing phase containing the chemical warfare agents in the first heated vessel 12 is removed from the first heated vessel 12 via a first discharge line 16 as a first gaseous discharge stream. This first gaseous discharge stream comprises a condensible moiety and a non-condensible moiety.

After removal from the first heated vessel 12, the first gaseous discharge stream is heated in a substantially dry second vessel 18 at substantially ambient pressure to at least about 500° C. (typically between about 500° C. and about 700° C.). Within the second vessel 18, the first gaseous discharge stream is maintained at a temperature of at least about 500° C. for a period of at least about one second in an atmosphere containing steam. Typically, the steam and the second vessel 18 is at a concentration between about 150% and about 350% of stoichiometry, preferably between about 250% and about 300% of stoichiometry, and most preferably between about 225% and about 275% of stoichiometry. Typically, the first gaseous discharge stream is thus maintained within the second vessel for a period of between about 1 and 10 seconds, most typically between about 1 and about 5 seconds. The term "stoichiometry" in this sense is meant to indicate the quantity of steam theoretically capable of reacting all of the chemical warfare agents within the first gaseous discharge stream to non-chemical warfare agents. By this step, at least about 99 wt. %, typically at least about 99.9 wt. % and, most typically, at least about 99.99 wt. %, of the chemical warfare agents within the first gaseous discharge stream are converted to non-chemical warfare agents.

The gaseous mixture within the second vessel 18 is removed from the second vessel 18 via the second gaseous discharge line 20 to a reactor 28 as a second gaseous discharge stream. This second gaseous discharge stream also comprises a condensible moiety and a non-condensible moiety.

The non-condensible moiety of the second discharge gaseous stream is removed from the second vessel 18 where it is catalytically treated in the presence of oxygen so as to reduce the concentration of chemical warfare agents within the non-condensible moiety to less than about 1.0 mg/m$^3$ (at standard pressure and temperature). This catalytic treatment step can be carried out in one of a large number of catalytic oxidation processes known in the art, such as the Thermatrix Blameless Oxidation process licensed by Thermatrix, Inc. of California, Edge II™ licensed by Alzeta Corporation of California and Econ-Abator Catalytic Oxidation Systems licensed by Huntington Environmental Systems of Illinois. The CATOX Process licensed by Honeywell, Inc. of Morristown, N.J. has been found to be particularly effective in the oxidation of chemical warfare agents within the non-condensible moiety of the second discharge stream to non-chemical warfare agents. This process is disclosed in detail in U.S. Pat. No. 6,080,906, the entirety of which is incorporated herein by this reference.

Figure 2:
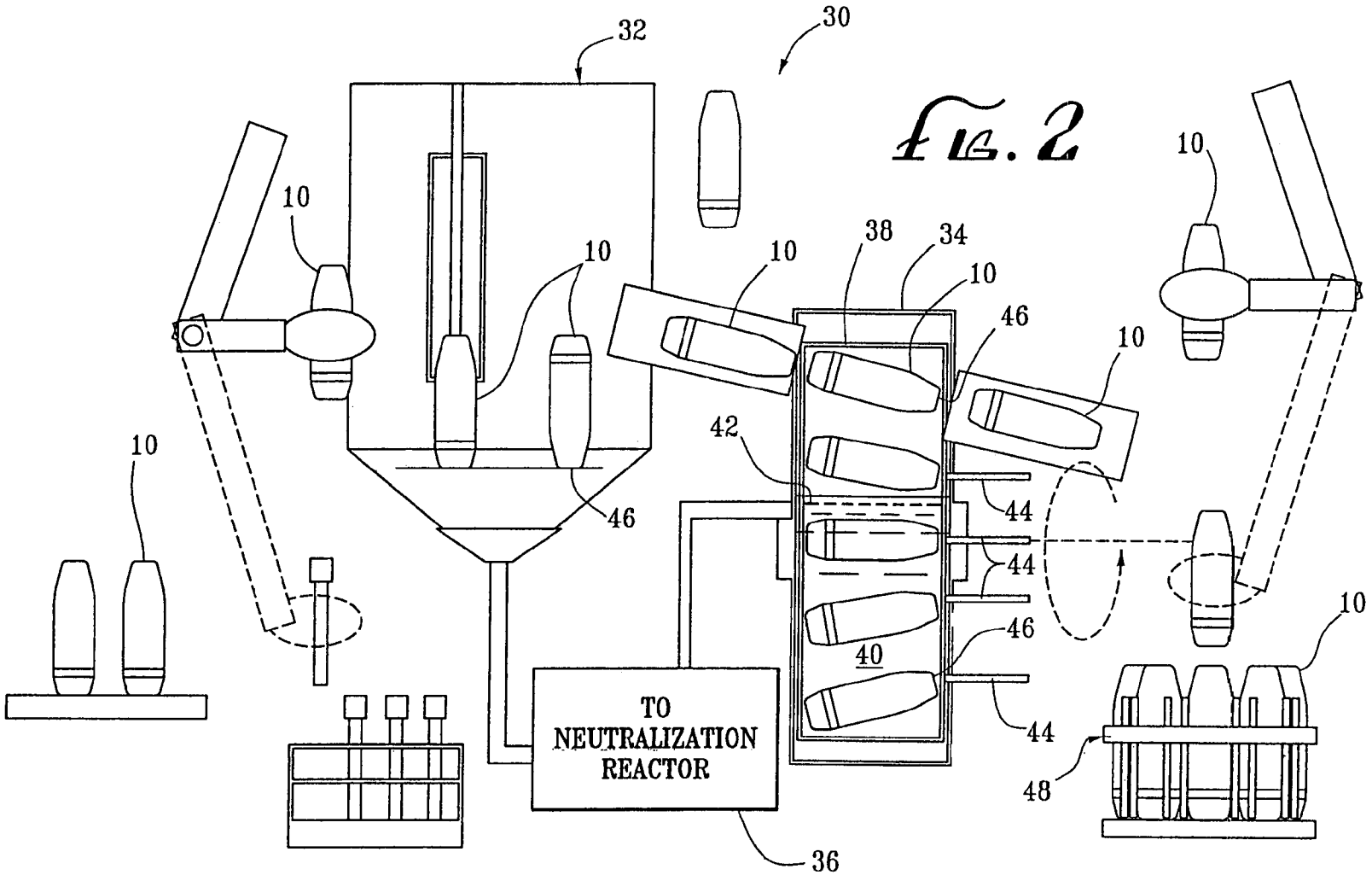
FIG. 2 is a diagrammatic cross-sectional side view of flushing apparatus useable in the invention.

As illustrated in FIG. 2, the chemical weapon components 10 can be flushed out using a flushing apparatus 30 comprising a primary flushing vessel 32 and a secondary flushing vessel 34. In the primary flushing vessel 32, the chemical weapon components 10 are initially opened and the mobile chemical warfare agents contained therein are dumped into the bottom of the primary flushing vessel 32 for removal to the separate treating facility 36. After substantially all of the mobile chemical warfare agents have gravitated out of each chemical weapon component 10, the chemical weapon component 10 is placed into the secondary flushing vessel 34.

The secondary flushing vessel 34 contains a rotating carousel 38 which is partially submerged within a quantity of liquid flushing agent 40, such as water or other solvent. The carousel 38 rotates individual chemical weapon components 10 into and out of the flushing agent. Both above and below the liquid level 42, high pressure sprayers 44 are capable of spraying liquid flushing agent into the open ends 46 of the chemical weapon components 10 to flush out additional amounts of chemical warfare agents.

Preferably, the carousel 38 is adapted to retain each chemical weapon component 10 at an angle of between about 30° and about 90° with respect to the horizontal so that the open end 46 of each chemical warfare component 10 is canted downwardly when the chemical weapon component 10 is disposed at the top of the carousel 38 and is canted upwardly when rotated to the bottom of the carousel 38. By this design, the chemical weapon components 10 within the carousel 38 automatically drain when rotated to the top of the carousel 38 and automatically draw liquid into each chemical weapon component 10 when rotated to the bottom of the carousel 38.

After exiting the secondary flushing vessel 34, the chemical weapon components 10 are placed into the first heated vessel 12 where they are contacted with steam as described above. As illustrated in the drawings, the first heated vessel 12 can be equipped with electrical heating coils 47 so that the first heated vessel 12 can be heated electrically, preferably by induction heating.

Figure 3:
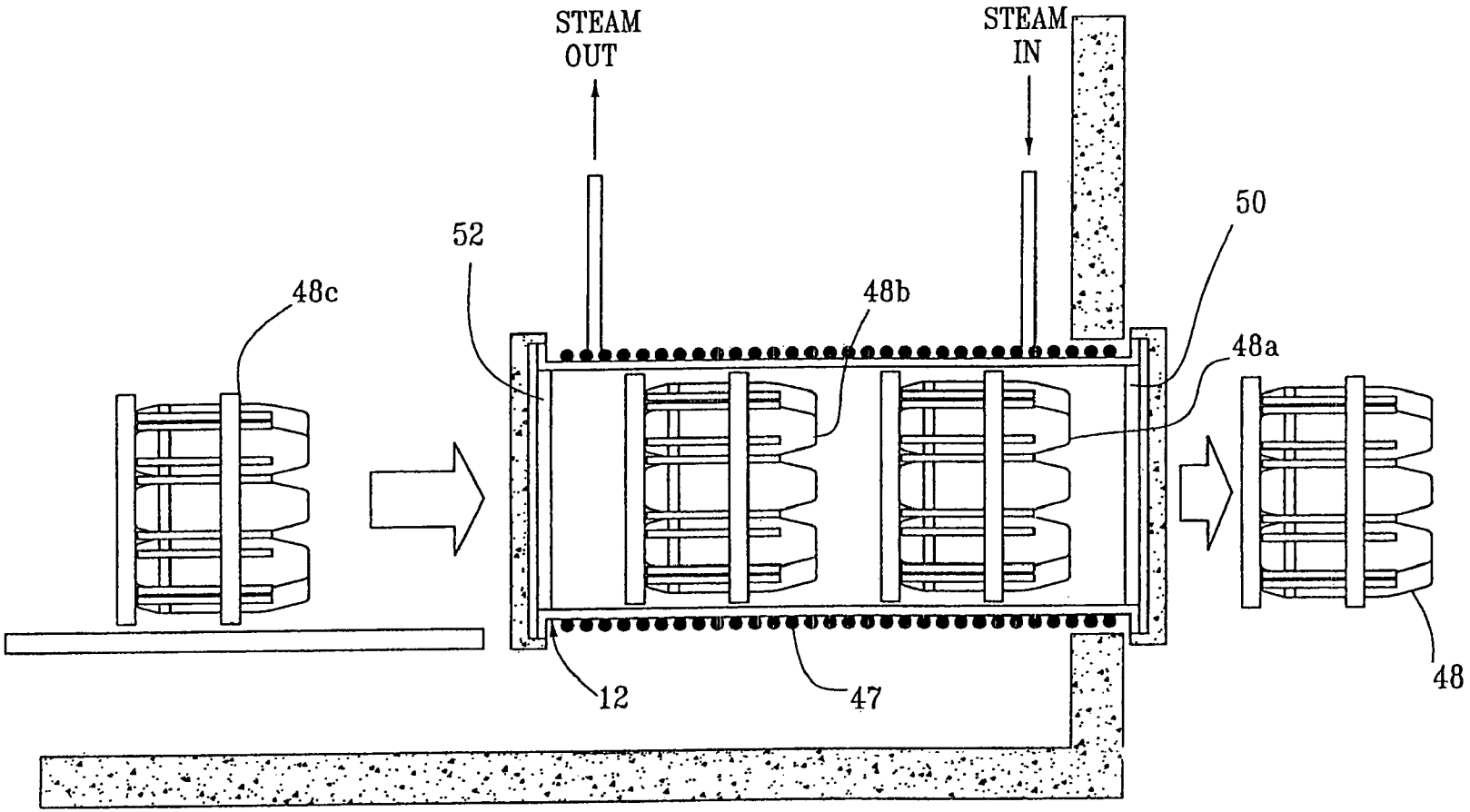
FIG. 3 is a diagrammatic cross-sectional side view of a heated vessel useful in the invention.

Operation of the first heated vessel 12 can be carried out in a batch-wise mode or can be carried out in a semi-batch, semi-automatic or fully automatic modes. FIG. 3 illustrates the operation of the first heated vessel 12 in a semi-batch mode. As illustrated in FIG. 3, the first heated vessel 12 houses a pair of discrete bundles 48 of chemical weapon components 10. Typically, each bundle 48 is a palletized plurality of chemical weapon components 10. Each bundle 48 is subjected to two separate applications of heated steam.

After each application, the forward-most bundle 48*a* is removed from the outlet end 50 of the first heated vessel 12, the rearward-most bundle 48*b* is moved forward within the first heated vessel 12 and a new bundle 48*c* is disposed within the first heated vessel 12 at the inlet end 52 of the first heated vessel 12.

In another embodiment (not shown), chemical weapon components 10 are loaded onto one or more trays which are pushed through the first heated vessel 12 in a similar fashion as the bundles 48 described immediately above.

Figures 4A, 4B:
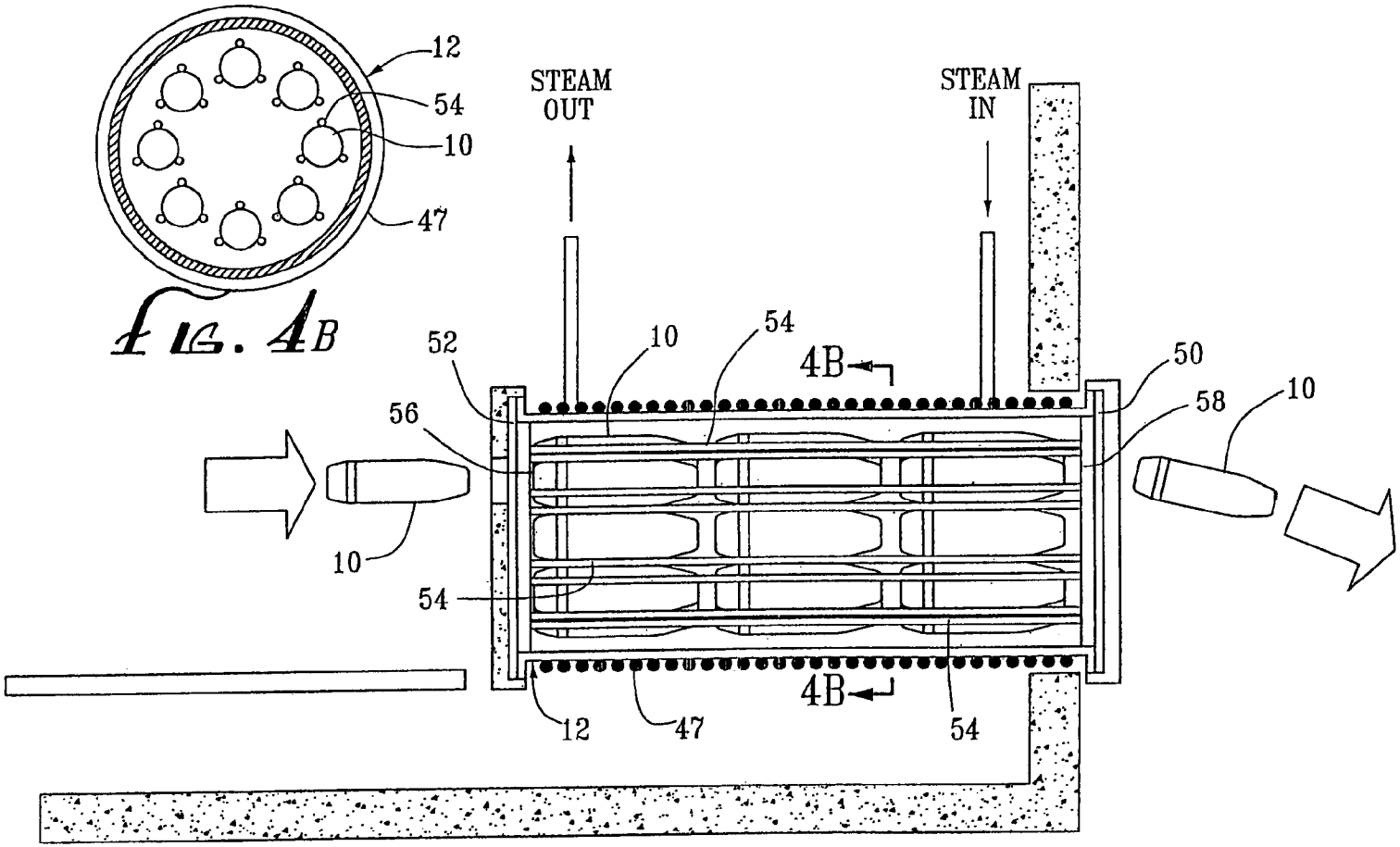
FIG. 4A is a diagrammatic cross-sectional side view of a second heated vessel useful in the invention.
FIG. 4B is a cross-sectional view of the heated vessel illustrated in FIG. 4A, taken along line 4B-4B.

FIGS. 4A and 4B illustrate a semi-automatic embodiment. In this embodiment, a plurality of elongate racks 54 are disposed within the first heated vessel 12. Each rack 54 is adapted to accept, end-to-end, a plurality of individual chemical weapon components 10. A charging mechanism (not shown) is disposed at the inlet end 52 of the first heated vessel to charge one chemical weapon component 10 at a time into the inlet end 56 of one of the racks 54. As one chemical weapon component 10 is charged into the inlet end 56 of a rack 54, a fully decontaminated chemical weapon component 10 is removed at the outlet end 58 of that rack 54 by a discharging mechanism (not shown). Either the charging and discharging mechanisms or the racks 54 rotate about the longitudinal axis 59 of the first heated vessel 12 so that the charging mechanism loads a chemical weapon component 10 into each of the racks 54 in repeated, serial fashion. By this operation, all of the racks 54 are serially loaded and unloaded.

Figure 5:
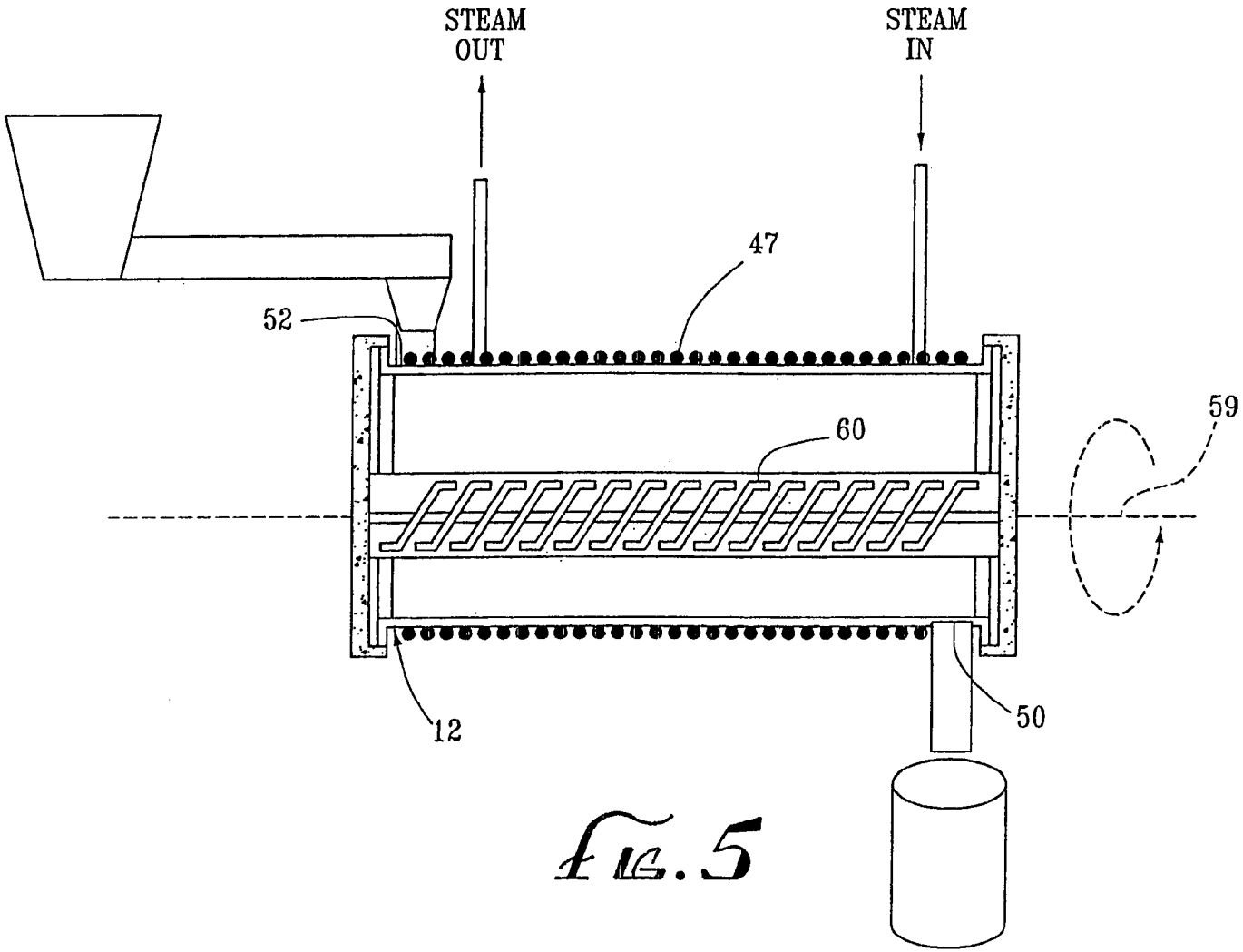
FIG. 5 is a diagrammatic cross-sectional side view of a third heated vessel useful in the invention.

FIG. 5 illustrates yet another embodiment of the invention. This embodiment of the invention can be operated in either a semi-automatic or full automatic configuration. In this embodiment, an auger 60 is disposed within the first heated vessel 12. Its configuration is suitable for chemical weapon components 10 of relatively reduced size, such as pre-shredded chemical weapon components 10. In this embodiment, as the auger 60 slowly rotates, chemical weapon components 10 are slowly moved from the inlet end 52 of the first heated vessel 12 towards the outlet end 50 of the first heated vessel 12.

In many cases, operation of this embodiment is facilitated by loading the chemical weapon components 10 within the first heated vessel 12 with a filler material, such as crushed limestone, aluminum silicate or granulated charcoal. Typically, the filler material is comprised of clumps having a width between about ¼ inch and about 1 inch, typically between about ¼ inch and about ½ inch. In a typical operation, such filler material comprises between about one third and about two thirds of the volume of loose material within the first heated vessel 12. The filler material is removed at the outlet end 50 of the first heated vessel 12 with the fully decontaminated chemical weapon components. The filler material is then separated from the chemical weapon components 10, such as by screening or air blasting. Thereafter, the filler material can be recycled for repeated uses within the process.

Figure 6:
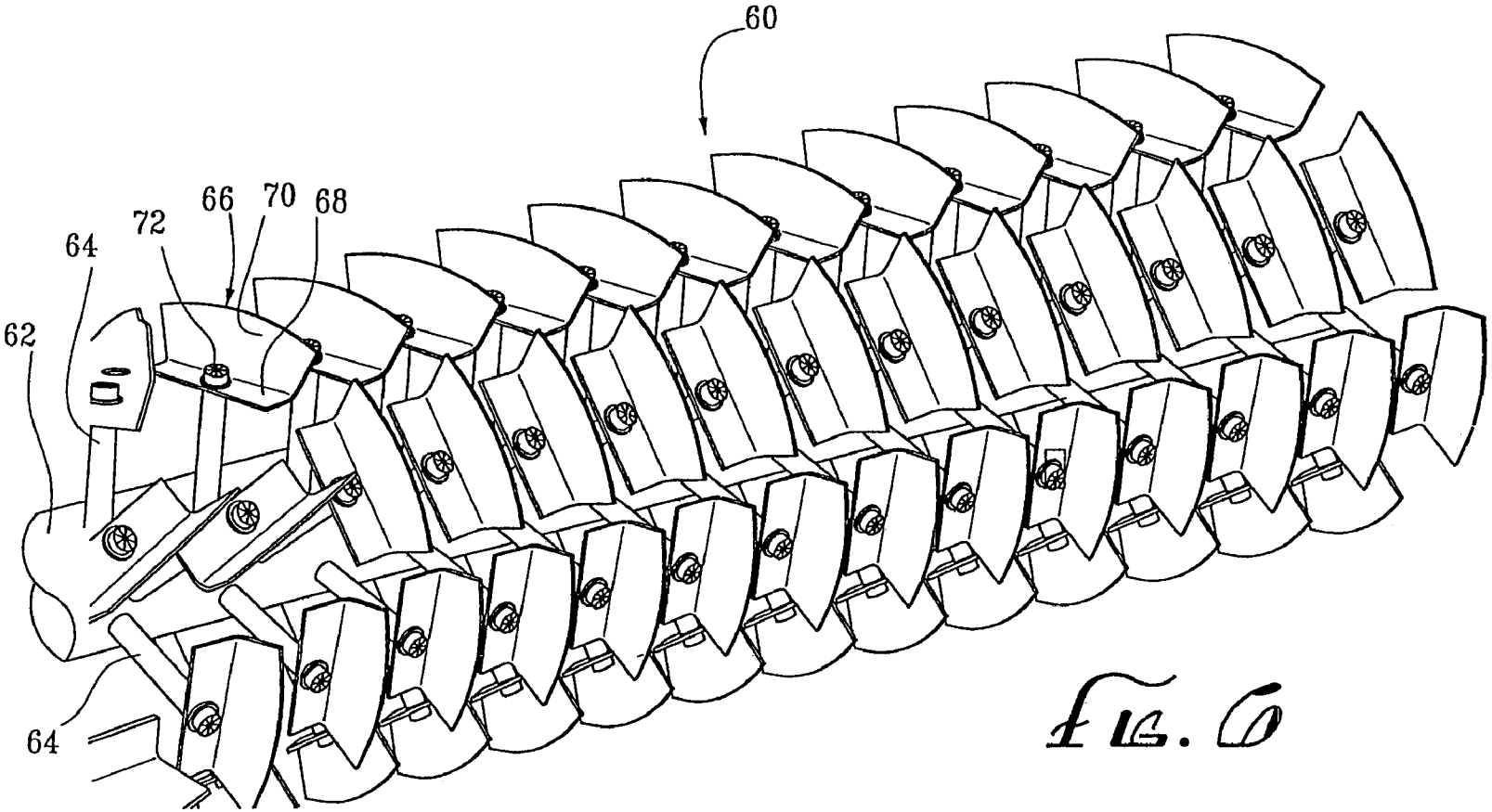
FIG. 6 is a detailed perspective view of an auger useful in the invention.

FIG. 6 illustrates in detail an auger configuration useful in this embodiment. In this configuration, the auger 60 is composed of an axially rotating central member 62 to which is attached a plurality of outwardly radiating support members 64. The support members 64 are disposed in a spiral about the central member 62. At the distal end of each support member 62 is an auger blade 66. In the embodiment illustrated in FIG. 6, each auger blade 66 is L-shaped, having a lateral component 68 and a vertical component 70. The auger blades 66 are attached to the support elements 64 in an adjustable fashion, such as by being attached with a bolt and nut 72. By being adjustable, the angle of the individual auger blades 66 can be optimally adjusted to smoothly move loose material through the first heated vessel 12.

For many materials, it has been found that varying the angle of the auger blades 66 along the length of the auger 60 can be beneficial. In some operations, it can actually be beneficial to angle some of the auger blades 66 to nudge material backwards within the first heated vessel 12 while the remainder of the auger blades 66 are angled to push the material forward. Such a configuration has been found to be advantageous in maintaining the smooth flow of certain materials through the first heated vessel 12.

The invention has been found to provide an extremely effective method for decontaminating chemical weapon components without having to resort to incineration steps. Because the process is carried out at substantially ambient pressures, capital, operating and maintenance costs are reduced to a minimum. The invention can also provide an effective method for minimizing the overall quantity of a "mixed" waste containing organic contaminants and radioactive contaminants. The non-radioactive portion of any such mixed waste can be substantially eliminated by use of the invention, thus minimizing the overall quantity of waste which must be disposed of. The invention has also been further found to provide an effective method for decontaminating other contaminated materials containing hazardous agents, such as contaminated soils.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A process for the low temperature, non-incineration decontamination of contaminated materials containing hazardous agents, the process comprising:

(a) contacting the contaminated materials and the hazardous agents with steam at substantially ambient pressure in a substantially dry first heated vessel for a period of at least about 15 minutes, the steam being at a temperature of at least about 560° C., whereby essentially all of the hazardous agents are removed from the contaminated materials;

(b) removing a first gaseous discharge stream containing hazardous agents from the first heated vessel, the first gaseous discharge stream comprising a condensible moiety and a non-condensible moiety;

(c) heating the first gaseous discharge stream at substantially ambient pressure in a substantially dry second vessel to at least about 500° C. and maintaining the first gaseous discharge stream in the second vessel of at least about 500° C. for a period of at least about one second in an atmosphere containing sufficient steam such that, such that at least about 99 weight percent of the hazardous agents within the first gaseous discharge stream are converted to non-hazardous agents;

(d) removing a second gaseous discharge stream containing a reduced concentration of hazardous agents from the second vessel, the second gaseous discharge stream comprising a condensible moiety and a non-condensible moiety; and (e) catalytically treating the second gaseous discharge stream in the presence of oxygen so that the concentration of hazardous agents within the non-condensible moiety of the second gaseous discharge stream is reduced to less than about 1.0 $mg/m^3$ at standard temperature and pressure.

2. The process of claim 1 wherein the contacting of the contaminated materials and hazardous agents with steam in step (a) is carried out using steam at a temperature between about 560° C. and about 750° C.

3. The process of claim 1 wherein the contacting of the contaminated materials and hazardous agents with steam in step (a) is carried out for a period of between about 15 minutes and about 4 hours.

4. The process of claim 1 wherein the contacting of the contaminated materials and hazardous agents with steam in step (a) is carried out for a period of between about 15 minutes and about 120 minutes.

5. The process of claim 1 wherein the maintaining of the first gaseous discharge stream at a temperature greater than about 500° C. in step (c) is carried out at a temperature between about 500° C. and about 700° C.

6. The process of claim 1 wherein the maintaining of the first gaseous discharge stream at a temperature of at least about 500° C. in step (c) is carried out for a period between about 1 second and about 10 seconds.

7. The process of claim 1 wherein the maintaining of the first gaseous discharge stream at a temperature of at least about 500° C. in step (c) is carried out for a period between about 1 second and about 5 seconds.

8. The process of claim 1 wherein the heating and maintaining of the first gaseous discharge stream at a temperature of at least about 500° C. in step (c) converts at least about 99.99% of the chemical warfare agents within the first gaseous discharge stream to non-chemical warfare agents.

9. A process for the low temperature, non-incineration decontamination of chemical weapon components containing chemical warfare agents, the process comprising:

(a) contacting the chemical weapon components and the chemical warfare agents with steam at substantially ambient pressure in a substantially dry first heated vessel for a period of at least about 15 minutes, the steam being at a temperature of at least about 560° C., whereby essentially all of the chemical warfare agents are removed from the chemical weapon components;

(b) removing a first gaseous discharge stream containing chemical warfare agents from the first heated vessel, the first gaseous discharge stream comprising a condensible moiety and a non-condensible moiety;

(c) heating the first gaseous discharge stream at substantially ambient pressure in a substantially dry second vessel to at least about 500° C. and maintaining the first gaseous discharge stream in the second vessel of at least about 500° C. for a period of at least about one second in an atmosphere containing sufficient steam, such that whereby at least about 99 weight percent of the chemical warfare agents within the first gaseous discharge stream are converted to non-chemical warfare agents;

(d) removing a second gaseous discharge stream containing a reduced concentration of chemical warfare agents from the second vessel, the second gaseous discharge stream comprising a condensible moiety and a non-condensible moiety; and (e) catalytically treating the second gaseous discharge stream in the presence of oxygen so that the concentration of hazardous agents within the non-condensible moiety of the second gaseous discharge stream is reduced to less than about 1.0 $mg/m^3$ at standard temperature and pressure.

10. The process of claim 9 wherein the contacting of the chemical weapon components and chemical warfare agents with steam in step (a) is carried out using steam at a temperature between about 560° C. and about 750° C.

11. The process of claim 9 wherein the contacting of the chemical weapon components and chemical warfare agents with steam in step (a) is carried out for a period of between about 15 minutes and about 4 hours.

12. The process of claim 9 wherein the contacting of the chemical weapon components and chemical warfare agents with steam in step (a) is carried out for a period of between about 15 minutes and about 120 minutes.

13. The process of claim 9 wherein the maintaining of the first gaseous discharge stream at a temperature greater than about 500° C. in step (c) is carried out at a temperature between about 500° C. and about 700° C.

14. The process of claim 9 wherein the maintaining of the first gaseous discharge stream at a temperature of at least about 500° C. in step (c) is carried out for a period between about 1 second and about 10 seconds.

15. The process of claim 9 wherein the maintaining of the first gaseous discharge stream at a temperature of at least about 500° C. in step (c) is carried out for a period between about 1 second and about 5 seconds.

16. The process of claim 9 wherein the heating and maintaining of the first gaseous discharge stream at a temperature of at least about 500° C. in step (c) converts at least about 99.99% of the chemical warfare agents within the first gaseous discharge stream to non-chemical warfare agents.

17. A process for the low temperature, non-incineration decontamination of chemical weapon components containing chemical warfare agents, the process comprising:

(a) contacting the chemical weapon components and the chemical warfare agents with steam at substantially ambient pressure in a substantially dry first heated vessel for a period of between about 15 minutes and about 120 minutes, the steam being at a temperature of between about 560° C. and about 750° C., whereby essentially all of the chemical warfare agents are removed from the chemical weapon components;

(b) removing a first gaseous discharge stream containing chemical warfare agents from the first heated vessel, the first gaseous discharge stream comprising a condensible moiety and a non-condensible moiety;

(c) heating the first gaseous discharge stream at substantially ambient pressure in a substantially dry second vessel to at least about 500° C. and maintaining the first gaseous discharge stream in the second vessel at a temperature between about 500° C. and about 700° C. for a period of between about 1 second and about 5 seconds in an atmosphere containing sufficient steam, such that whereby at least about 99.99 wt. % of the chemical warfare agents within the first gaseous discharge stream are converted to non-chemical warfare agents;

(d) removing a second gaseous discharge stream containing a reduced concentration of chemical warfare agents from the second vessel, the second gaseous discharge stream comprising a condensible moiety and a non-condensible moiety; and (e) catalytically treating the second gaseous discharge stream in the presence of oxygen so that the concentration of hazardous agents within the non-condensible moiety of the second gaseous discharge stream is reduced to less than about 1.0 $mg/M^3$ at standard temperature and pressure.

18. The process of claim 17 wherein the first vessel is an electrically heated vessel.

19. The process of claim 18 wherein the first vessel is heated by electrical induction.

20. The process of claim 9 wherein, prior to the contacting of the chemical weapon components and the chemical warfare agents with steam in step (a), the chemical weapon components are flushed with a liquid flushing agent in a flushing vessel, the flushing vessel comprising a liquid level of flushing agent and an internally disposed carousel for rotating a plurality of chemical weapon components into and out of flushing agent.

21. The process of claim 20 wherein the flushing vessel further comprises a plurality of spray nozzles for spraying flushing agent into the chemical weapon components.

22. The process of claim 21 wherein the spray nozzles include at least one spray nozzle disposed above the liquid level of the flushing agent within the flushing vessel and at least one spray nozzle disposed below the liquid level.

23. The process of claim 9 wherein, during the contacting of chemical weapon components and chemical warfare agents with steam in step (a), the first vessel contains a plurality of discrete chemical weapon component bundles, each bundle containing a plurality of chemical weapon components.

24. The process of claim 23 wherein each chemical weapon component bundle is contacted in step (a) with steam of at least about 560° C. for at least two different and distinct periods of at least about 15 minutes each.

25. The process of claim 9 wherein the first vessel comprises a plurality of elongate racks, each elongate rack being sized and dimensioned to retain a plurality of chemical weapon components.

26. The process of claim 25 wherein the first vessel has a longitudinal axis and wherein the elongate racks are rotatable about the longitudinal axis.

27. The process of claim 9 wherein the contacting of chemical weapon components and chemical warfare agents with steam in step (a) is conducted using an auger disposed within the first vessel to move chemical weapon components from an inlet end of the first vessel to an outlet end of the first vessel.

28. The process of claim 27 wherein the auger comprises a plurality of adjustable blades.

29. The process of claim 28 wherein, during the contacting of the chemical weapon components and chemical warfare agents with steam in step (a), a filler material is mixed with the chemical weapon components within the first vessel.

* * * * *